United States Patent [19]

Hartwig

[11] Patent Number: 4,875,797

[45] Date of Patent: Oct. 24, 1989

[54] PARKING SPACE GUARD

[75] Inventor: Klaus Hartwig, Toronto, Canada

[73] Assignee: Kaymar-Parkguard Inc., Toronto, Canada

[21] Appl. No.: 207,116

[22] Filed: Jun. 14, 1988

[51] Int. Cl.[4] ..... E01F 9/00

[52] U.S. Cl. ..... 404/9; 404/6

[58] Field of Search ..... 404/6, 9, 20; 49/35, 49/49, 131; 248/160, 357; 40/607, 610, 612

[56] References Cited

U.S. PATENT DOCUMENTS

| | | | |
|---|---|---|---|
| 3,925,929 | 12/1975 | Montgomery | 49/35 |
| 4,050,190 | 9/1977 | Mazzone | 49/35 |
| 4,090,465 | 5/1978 | Bell, Sr. | 40/612 |
| 4,462,711 | 7/1984 | Garner | 40/612 |
| 4,762,439 | 8/1988 | Carlyle | 49/35 |

*Primary Examiner*—Stephen J. Novosad
*Assistant Examiner*—Gay Spahn

[57] ABSTRACT

The present invention provides a parking space guard comprising a base for anchoring the guard to a supporting surface and a blocker movable from a down access to an up blocking position. The base comprises a mounting plate with a pair of upstanding arms between which the blocker is pivotally and lockably secured and the arms are forwardly open for raising and lowering the blocker. The base further includes a forwardly extending channel in which the blocker lies when in the down position for lowering of the upper end of the blocker to ground level.

2 Claims, 3 Drawing Sheets

PARKING SPACE GUARD

FIELD OF THE INVENTION

The present invention relates to a parking space guard with a blocker movable between a down position allowing access to the parking space and an upright position for blocking the parking space against unauthorized use.

BACKGROUND OF THE INVENTION

Most apartment buildings as well as many office buildings have reserved parking areas specifically for tenants of the building. In many cases, these reserved parking areas are left unattended and accessible to unauthorized use. In many instances, visitors to the building, who are unable to find any visitor parking will use the reserved parking spaces if they are not properly guarded.

There are presently available some different types of parking space guards in the form of blocking members movable between up and down positions. However, most of these guards are quite complicated in terms of their construction and the manner in which they are locked. Furthermore, even when in a down or access gaining position the blocking members are still subject to catching on the undercarriage of a car passing over them.

A further problem with presently available parking space guards is that the blocking members do not necessarily have a specific direction in which they are laid down to gain access to the parking space. This can present problems when the guard is located next to a sidewalk or close to the road where, if the blocking member is improperly placed, it can well block traffic.

SUMMARY OF THE PRESENT INVENTION

The present invention provides a parking space guard comprising a base for anchoring the guard to a supporting surface and a blocker for moving from a down access to an up blocking position. The base comprises a mounting plate with a pair of upstanding arms between which the blocker is pivotally and lockably secured. The arms are forwardly opened for raising and lowering the blocker with the base further including a forwardly directed channel in which the blocker lies when in the down position for lowering of the upper end of the blocker to ground level.

BRIEF DISCUSSION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
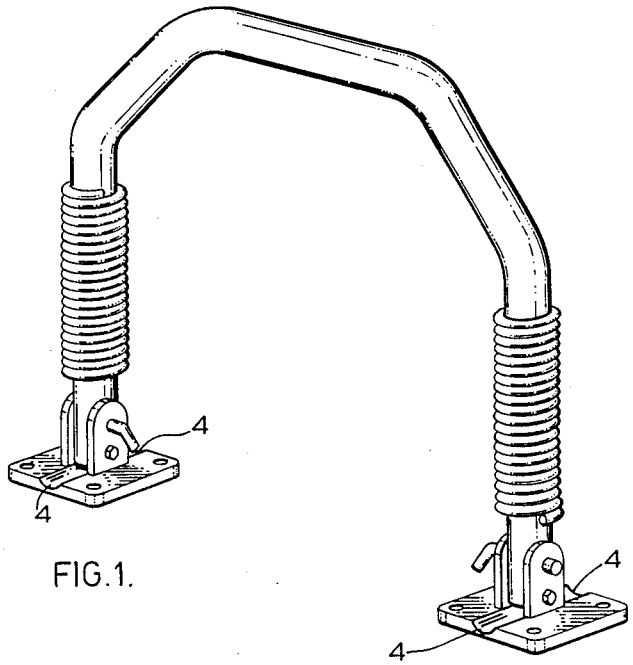
FIG. 1 is a perspective view of a parking space guard according to a preferred embodiment of the present invention with the blocker in the upright blocking position.
Figure 2:
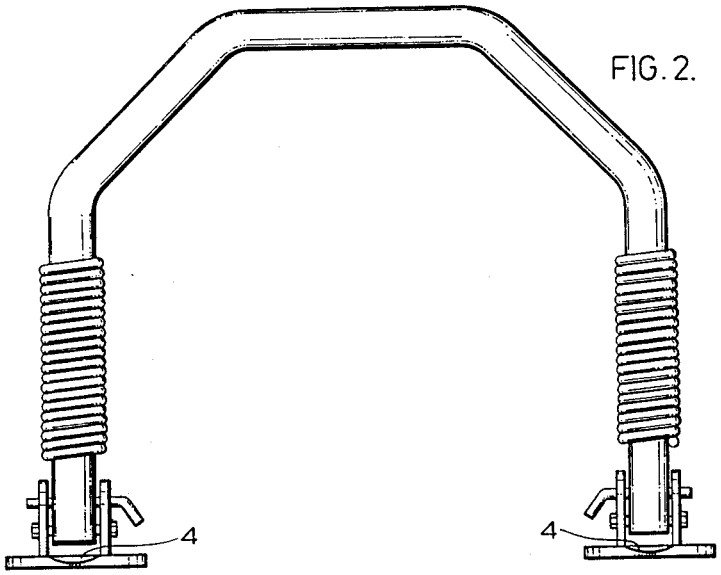
FIG. 2 is a plan view of the guard of FIG. 1.
Figure 3:
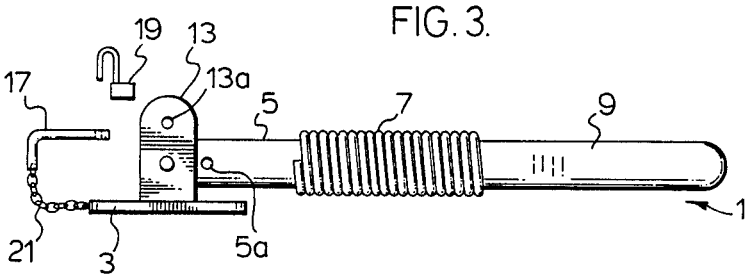
FIG. 3 is an end view of the guard of FIG. 1 with the blocker in the down position.

FIGS. 1 through 3 show a parking space guard generally indicated at 1. This guard comprises a pair of foot pads 3 for achoring the guard to a supporting surface such as a cement parking lot or the like. Extending upwardly from each of the foot pads is a leg member comprising a lower rigid leg portion 5, an upper rigid leg portion 9 and an intermediate coil spring portion 7. The two upper leg portions are connected across the guard by a transverse portion forming a continuation of leg portions 9 providing a blocker that moves between the up and down positions as a single unit.

One of the key features of the present invention is its rugged yet simple construction including both the construction of each of the leg members and the mounting structure for the leg members at the foot pads.

Figure 4:
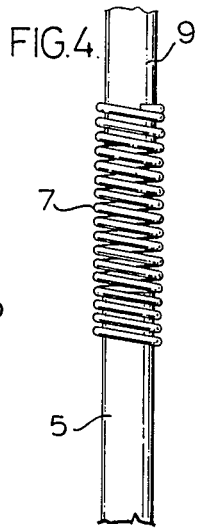
FIG. 4 is an enlarged view of the coil spring region on the leg of the blocker of FIGS. 1 through 3.

FIG. 4 shows the assembly of the upper and lower rigid leg portions with the intermediate coil spring of each leg member. Here it will be seen that the coil spring which forms a natural thread is in effect threadably secured or wound at its upper and lower ends over the upper and lower rigid leg portions respectively. Once the arrangement has been assembled, as shown in FIG. 4, the connections can be further secured by welding the ends of the spring to the leg portions.

As will be further seen in FIG. 4, the spring separates leg portions 5 and 9 so that it is internally hollow between these two leg portions allowing bending of the spring. However, it is to be appreciated that the spring itself is extremely heavy duty, e.g. in the order of about 3 inches in diameter with the rigid leg portions themselves having about a 2 inch diameter so that the spring will only bend under substantial forces of a magnitude that might otherwise damage the guard or a vehicle impacting it. Clearly the spring does not give the impression of being easily bendable thereby reducing the likelihood of someone intentionally running into the guard.

The spring is set at a height extending from about 10 inches to about 2 feet so that it is at impact level with almost all automobile and truck bumper heights again reducing as much as possible the risk of damage to the guard.

Figure 5:
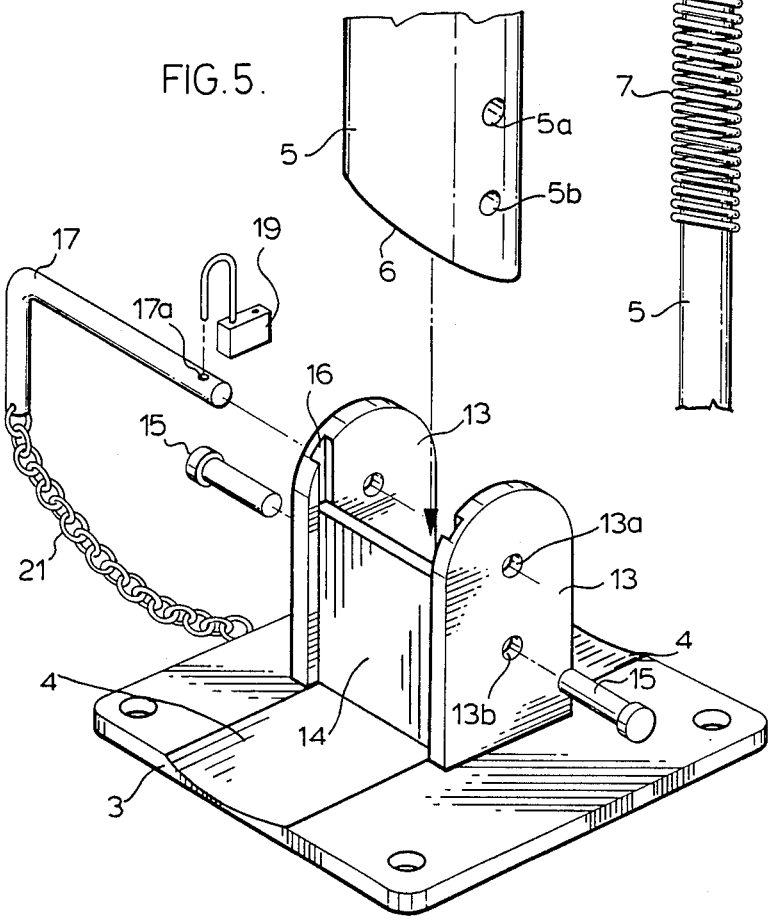
FIG. 5 is an exploded perspective view of one of the lower leg regions and foot pad assemblies of the guard of FIG. 1.

The mounting for each of the lower portions is shown in FIG. 5 where foot pads 3 include upstanding tongues 13 spaced from one another to allow a tight yet pivotal fitting of leg portion 5 therebetween. Each of the tongues is provided with a pair of openings 13*a* and 13*b* aligned with one another on the tongues. Leg portion 5 is, in turn, provided with upper and lower openings 5*a* and 5*b* respectively.

The pivotal mounting of the leg portion to the foot pad is provided by means of a non-releasable pivot pin 15, which fits through openings 13*b* on the tongues and passes through openings 5*b* on the lower leg portion. The locking means for locking the blocker in the upright position comprises a removable pin 17 which fits through the upper openings 13*a* on the tongues and passes through openings 5*a* on the leg portion. Pin 17 is, in turn, provided with an opening 17*a* for receiving lock 19 used to secure pin 17 once in its locking position. For convenience purposes, chain 21 is further provided to attach the pin to the foot pad 3 to assure that the pin is not inadvertantly moved away from the foot pad and is therefore readily available for use. Pin 17 can also be fitted through and locked in openings 13*a* when the blocker is in the down position to prevent it from being lifted up when not desired as shown in FIG. 8.

Figure 7:
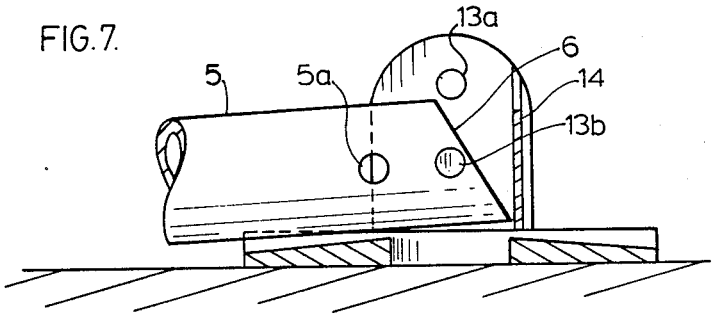

A number of unqiue features are provided in the foot pad itself. Firstly, the pad is of a substantial thickness at its four bolt down corners to provide an extremely effective anchoring of the blocker. However, in order to enable the blocker to lie down as far as possible and thereby avoid catching the under carriage of the automobile as it passes over the blocker, each of the foot pads is provided to both sides with a hollowed or recessed channel region 4. When the blocker is moved to the down position, as best seen in FIG. 7 of the drawings, it sits in this recess so that the blocker moves downwardly through something more than a 90° angle. With this arrangement, the extreme outer end of the blocker, again when in the down position, actually sits on the ground rather than being held off the ground as would be the case if the foot pad was not dished. This ground level positioning of the outer end of the blocker minimizes the likelihood of its catching on the undersurface of an automobile passing over the blocker. It further eliminates tampering by using the blocker as a lever arm in the down position to pop the foot pad out of the ground which would otherwise be possible if the blocker was supported on the foot pad above ground level.

Figure 6:
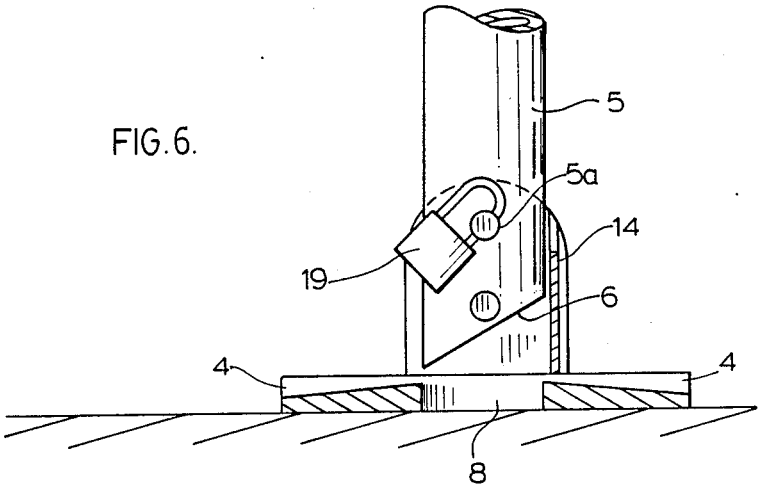
FIGS. 6 through 8 are cross-sectional views through the lower leg and mounting plate area of the blocker of FIG. 5 when assembled and in both the up and down positions.
Figure 8:
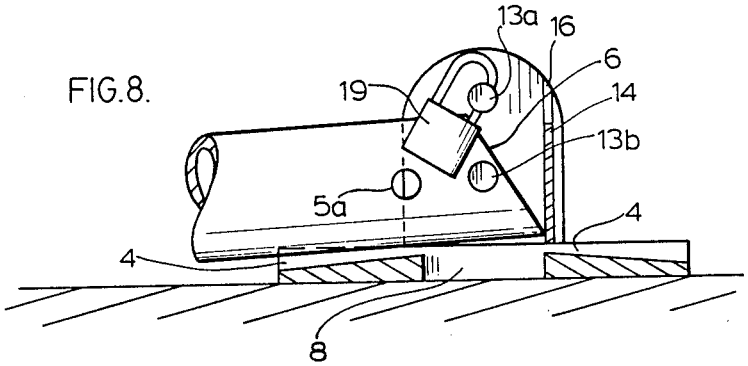

Also and as best seen in FIGS. 6 through 8, the foot pad in addition to being dished at 4 has a further recess 8 immediately beneath the lower ends 6 of the movable blocker. This recessing allows the blocker to be secured on the foot pad as close as possible to ground level for maximum strength purposes while still allowing the lower end of the blocker 6 to swing in and out of the recess for moving it from the up to the down position. Again, with the set up as shown in the drawings and without providing recess 8, the lower end of the blocker would not clear past the foot pad for moving it to and from the blocking position.

The drawings show that each of the foot pads is provided with dished areas 4 to both sides where the blocker can be laid down to either side of the foot pads. FIGS. 5 through 8 show a further embodiment of the present invention where the blocker is provided with a stop for allowing it to be laid down in one direction only. This particular embodiment is extremely useful where the blocker is positioned adjacent a sidewalk or near a roadway and where the stop prevents its from being laid down into a traffic area.

The stop itself is in the form of a plate 14 provided between tongues 13. The plate is inserted downwardly into slots 16 provided on each of the tongues for optional fitting of plate 14 which can then be secured in place as for example by welding. The other side or the front of the tongues remains open for swinging the blocker down onto the front dished area on the foot pad.

Again for clearance purposes, the bottom 6 on each of the leg portions 5 is cut at an angle to allow swinging of the lower leg relative to plate 14.

According to the construction above for both the leg members and the mounting of the leg members to the foot pads a number of benefits will be immediately apparent. Firstly, the overall construction is extremely simple while being very effective. Secondly, there are a number of contributing factors which result in the blocker's ability to resist impact. Firstly and most apparent, is the provision of the spring flexibility in each of the upright legs. Secondly, because locking means are provided at both of the leg members, each of these locking means, i.e. pins 17, will help to absorb impact pressure as opposed to all of the pressure being on a single pin which would have a much greater tendency to break or snap resulting in pre-mature releasing of the blocker from the upright position. It should be noted here that the springs are not located at the bottom of the legs but rather are moved upwardly along the legs so that any bending of the blocker is moved upwardly away from pins 17 further adding to their ability to withstand impact pressure. However, in the event that there is enough force applied on the lower leg portions to effect the mounting assembly, it is releasable pin 17 rather than the more permanent pivot pin 15 that will break because of the above and below positioning of the two sets of pins, i.e. all the force is placed on lock pins 17 because of their upper positioning relative to the pivot pins and these lock pins can be easily replaced in the event of damage. If pins 17 do break while the blocker is in the upright position, it will then simply pivot about pins 15 and fall to the down position without exerting any pressure on the pivot pins. If the blocking plates 14 are in use, they will assure that the guard does not inadvertantly fall into a traffic area.

Although various preferred embodiments of the invention have been described herein in detail, it will be appreciated by those skilled in the art that variations may be made without departing from the spirit of the invention or the scope of the appended claims.

The embodiments of the invention in which an exclusive property or privilege is claimed are defined as follows:

1. A parking space guard comprising a base for anchoring said guard to a supporting surface and a blocker movable from a down access to an up blocking position, said base comprising a mounting plate with a pair of upstanding arms between which said blocker is pivotally and lockably secured, said arms being forwardly open for raising and lowering said blocker, said base further including a forwardly extending channel in which said blocker lies when in the down position for lowering the outer end of said blocker to ground level, said mounting plate being recessed immediately beneath said blocker for clearance of the lower end of said blocker past said mounting plate while lowering to the down position.

2. A parking space guard as claimed in claim 1, wherein said upstanding arms are provided rearwardly with opposing slots for receiving a plate to prevent rearward lowering of said blocker.

* * * * *